United States Patent [19]

Raasch et al.

[11] 4,180,197

[45] Dec. 25, 1979

[54] STAPLING AND MARKING DEVICE

[75] Inventors: Ernest M. Raasch, Alpine, N.J.; Nathaniel M. Olney, New York, N.Y.

[73] Assignee: Swingline, Inc., Long Island City, N.Y.

[21] Appl. No.: 883,864

[22] Filed: Mar. 6, 1978

[51] Int. Cl.[2] ..... B25C 5/02; B25C 7/00

[52] U.S. Cl. ..... 227/120; 227/156

[58] Field of Search ..... 227/120, 156

[56] References Cited

U.S. PATENT DOCUMENTS

| | | | |
|---|---|---|---|
| 2,181,600 | 11/1939 | Hoffman | 101/426 |
| 2,716,748 | 9/1955 | Sutton | 227/156 |
| 2,859,443 | 11/1958 | Jopp | 227/156 |
| 2,996,720 | 8/1961 | Mackechnie | 227/120 |

*Primary Examiner*—John McQuade

*Attorney, Agent, or Firm*—Pennie & Edmonds

[57] ABSTRACT

A device for simultaneously stapling and marking a workpiece is disclosed. The device comprises a main body housing means for driving staples into a workpiece as well as means for supporting a removable marking unit. The marking unit is positioned in the housing in such a manner as to apply an identifying mark to the workpiece when the workpiece is stapled.

7 Claims, 7 Drawing Figures

STAPLING AND MARKING DEVICE

BACKGROUND OF THE INVENTION

With the increasing complexity in the operations of various commercial enterprises, there has been a growing need to monitor and identify various everyday record keeping and information handling activites. The inventive device is of significant value insofar as it permits the identification of papers by marking them without resort to a separate identification operation. Specifically, the inventive device allows the simultaneous application to a document of both a staple and an identification mark.

SUMMARY OF THE INVENTION

In accordance with the present invention, a stapling device is provided with a self-inking stamp, such as a microporous encapsulated stamp, positioned in the housing cavity formed by the rail which supports the staple strip. During the stapling operation, as the staple advances through the papers or other materials to be stapled, the top page or other material is marked with an appropriate legend by the stamp. The legend is useful in identifying the paper, the individual who stapled it, the department where the stapling was done, the day of the week, and so forth.

DETAILED DESCRIPTION OF THE PREFERRED EMBODIMENTS

Figure 1:
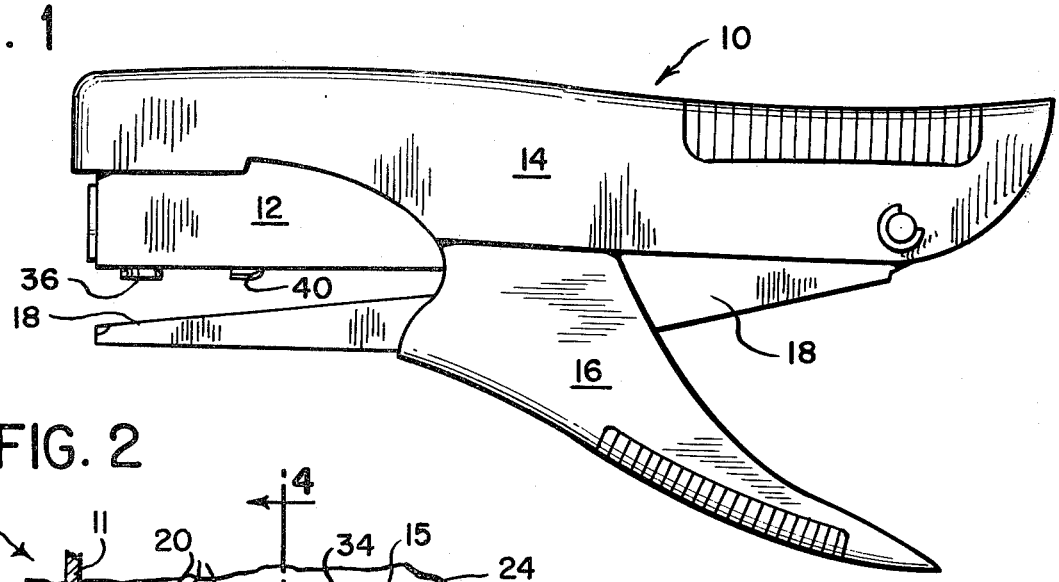
FIG. 1 is a side elevation view of the stapling device constructed in accordance with the present invention.
Figure 2:
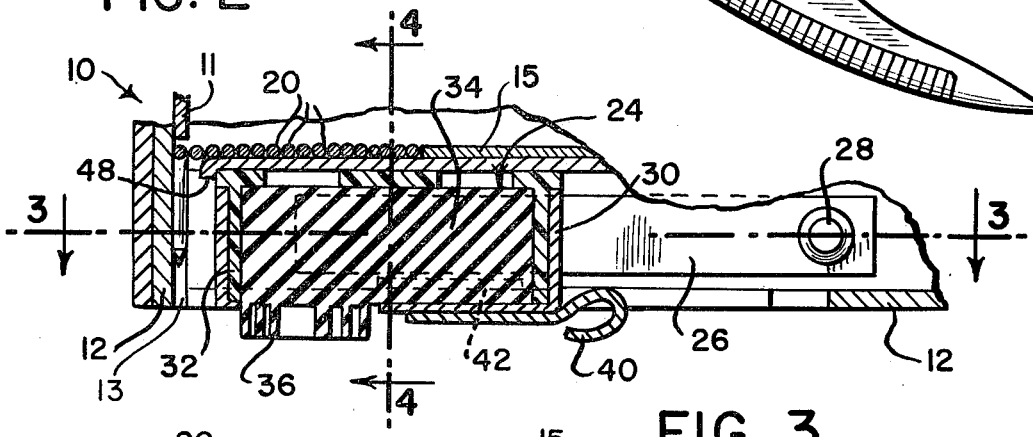
FIG. 2 is an enlarged cross-sectional view of the head of the device.
Figure 3:
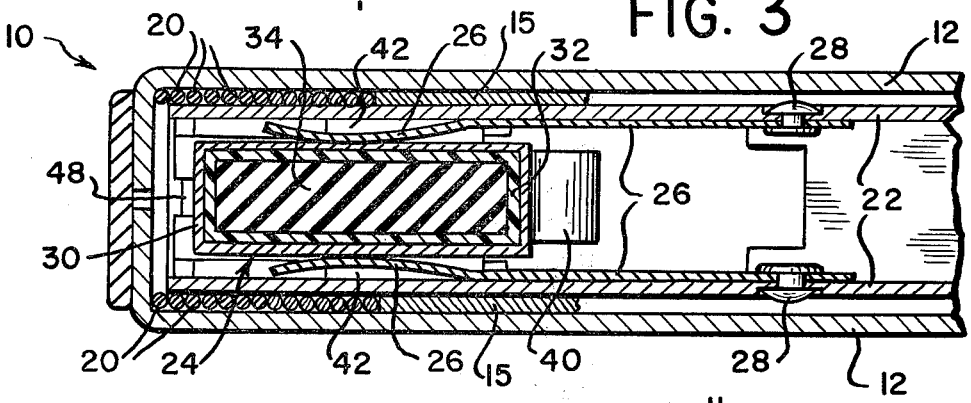
FIG. 3 is a cross-sectional view along line 3—3 of FIG. 2.
Figure 4:
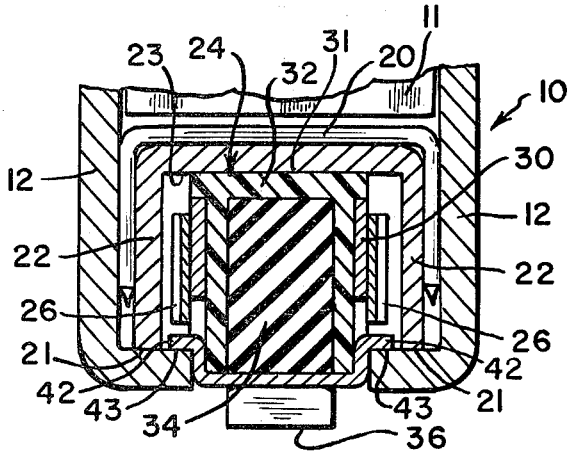
FIG. 4 is a cross-sectional view along line 4—4 of FIG. 2.

Referring to FIGS. 1–4, a stapler 10 constructed in accordance with the present invention is illustrated. The stapler comprises a housing 12, a cover 14 and an operating handle 16. Stapling and stamping is done against an anvil 18. Staples 20 are held in housing 12 between the inside wall of the housing and the outside wall of a staple supporting guide 22. The staples are urged by a conventional follower block 15 toward the front of the stapler and driven by a driver blade 11 along a channel 13 into the workpiece in a conventional manner. Operation of the stapler thus results in advancing housing 12 toward anvil 18 and driving staples into the workpiece.

Seated within the staple supporting guide 22 is a self-inking stamping element 24 of the microporous encapsulated type which is held in position by a pair of spring members 26. Spring members 26 are secured to staple supporting guide 22 by rivets 28. The self-inking stamping unit 24 comprises an external metal body 30 within which is supported a plastic casing 32. Metal body 30 serves the purpose of providing a rigid case which can be supported by spring members 26. The small size of spring members 26 allows the placement of unit 24 between the legs of the staples. A rubber stamp 34 made of a microporous plastic or rubber material is disposed within plastic casing 32. Rubber stamp 34 includes a stamping surface 36 which is shaped to form the appropriate legend.

Figure 5:
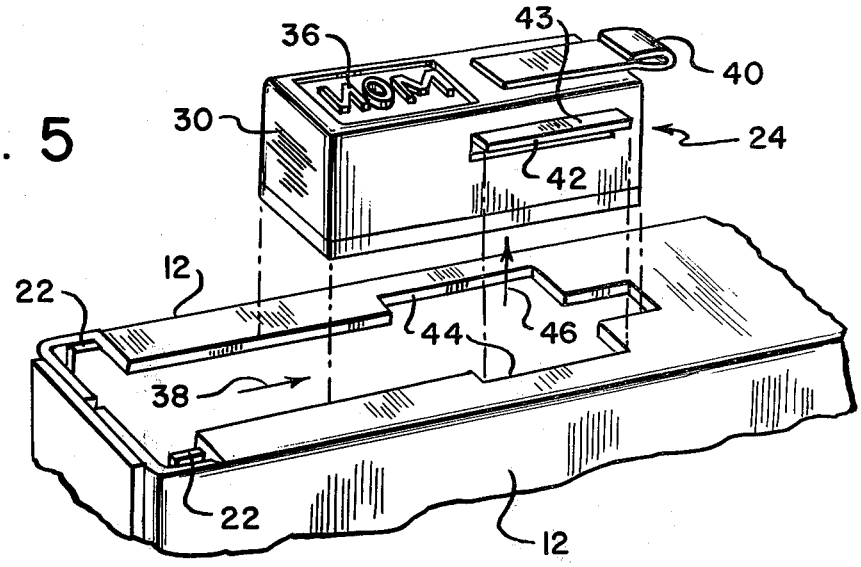
FIG. 5 is a perspective view of the underside of the head of the staple housing showing insertion of the self-inking stamp.

Insofar as it may be desirable to change the legend which is stamped by the inventive device, the rubber stamp unit 24 may be removed. Referring to FIG. 5, the unit 24 is first slid to the rear of the device in the direction indicated by arrow 38. This operation is facilitated by handle 40 secured to unit 24. When the unit reaches its most rearward position, locking tabs 42 are then in alignment with mating slots 44. Unit 24 may then be removed from the body in the direction indicated by arrow 46. A new stamping unit may then be placed in the inventive device by simply reversing this process. It is noted that the forward action of the unit in the direction opposite that indicated by arrow 38 is limited by a forward stud 48 extending from staple supporting guide 22.

Dimensionally, the distance between the bottom surface 43 of the locking tabs 42 and the top surface 31 of the casing 32 is substantially equal to the distance between the bottom surface 21 of the staple supporting guide 22 and the inside surface 23 of the guide 22, thus securing the stamping unit 24 in place.

Figure 6:
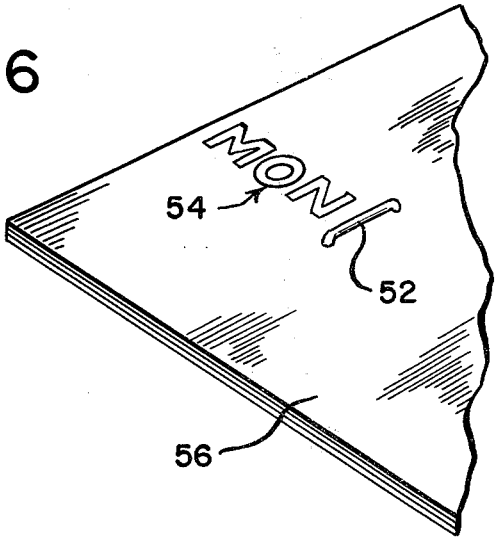
FIG. 6 shows a stack of papers after they have been stamped and stapled by the inventive device.
Figure 7:
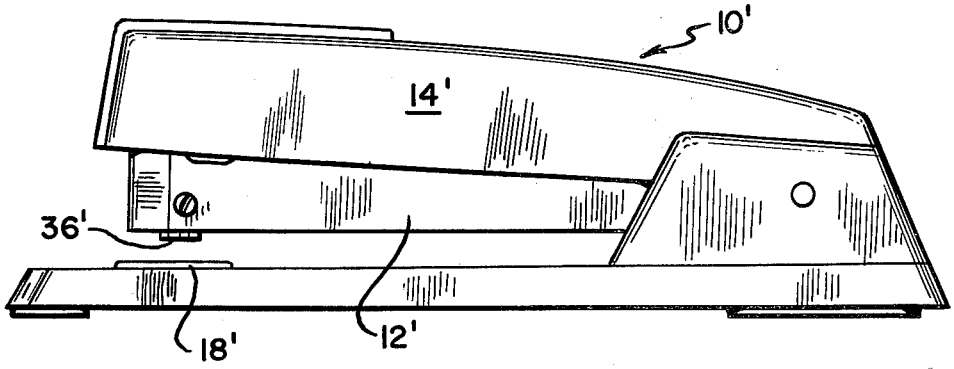
FIG. 7 is a side elevation view of an alternative embodiment of the present invention.

As illustrated in FIG. 6, operation of the inventive device results in the application of both a staple 52 and a marking legend 54 to the workpiece 56. The use of the device is particularly advantageous insofar as the stamping of the workpiece and driving of the staple is done in one operation. The inventive stamping and stapling device may take other forms such as the form of the desk stapling and stamping device 10' illustrated in FIG. 7. This device is essentially identical in its operation to the stapler device illustrated in FIGS. 1–6. The device 10' comprises a housing 12' and a cover 14'. Stapling and stamping by surface 36' are performed against an anvil 18'.

In the operation of the present invention, the marking in stamping surface 36 is supplied with sufficient ink between staplings and markings through ink migration to the surface. Thus, each time the device is actuated a staple is driven through the workpiece and a mark made thereon.

While the preferred embodiment of the invention has been disclosed, it is, of course, understood that various modifications in the size and configuration of the parts will be obvious to those of ordinary skill in the art and these modifications are within the spirit and scope of the invention which is limited only by the appended claims.

What is claimed is:

1. A stapling and marking device, comprising:

(a) anvil means;

(b) a housing having a front portion disposed over said anvil means;

(c) staple supporting means disposed in said housing for supporting a plurality of staples;

(d) means for urging said staples toward the front of said housing;

(e) means for driving said staples into a workpiece;

(f) marking means for marking a workpiece during stapling of the same; and (g) means for supporting said marking means within said housing underneath and within said staple supporting means.

2. A stapling and marking device as in claim 1, wherein said housing includes an opening for receiving said marking means and said means for supporting said marking means within said housing comprises a pair of spring members.

3. A stapling and marking device as in claim 2, wherein said opening includes a pair of slots and said marking means comprises a marker holder with a pair of locking tabs which mate with said slots during insertion of said marking means into said housing.

4. A stapling and marking device as in claim 3, wherein the distance between the bottom surface of said locking tabs and the top surface of said marker holder substantially equals the distance between the bottom surface of said staple supporting means and the inside surface of the top of said staple supporting means, whereby the locking tabs and top surface of said marker housing is securely held between said housing and said staple supporting means.

5. A stapling and marking device as in claim 4, further comprising handle means secured to said marker holder.

6. A stapling and marking device as in claim 4, further comprising stud means for limiting forward motion of said marking means within said housing.

7. A stapling and marking device as in claim 4, wherein said marking means comprises a self inking marking element and said marking means is disposed in said housing inside said staple supporting means.

* * * * *